US008256765B2

(12) United States Patent
Desire

(10) Patent No.: US 8,256,765 B2
(45) Date of Patent: Sep. 4, 2012

(54) HIGH-CAPACITY DEVICE FOR RECEIVING MAILPIECES

(75) Inventor: Régis Desire, Sceaux (FR)

(73) Assignee: Neopost Technologies, Bagneux (FR)

( * ) Notice: Subject to any disclaimer, the term of this patent is extended or adjusted under 35 U.S.C. 154(b) by 343 days.

(21) Appl. No.: 12/752,805

(22) Filed: Apr. 1, 2010

(65) Prior Publication Data

US 2010/0258406 A1 Oct. 14, 2010

(30) Foreign Application Priority Data

Apr. 9, 2009 (FR) ..... 09 52325

(51) Int. Cl.
*B65H 31/06* (2006.01)

(52) U.S. Cl. ..... 271/216; 271/2; 271/181; 271/198; 414/798.2

(58) Field of Classification Search ..... 271/2, 216, 271/177, 181, 185, 198, 150; 198/347.3; 414/798.2
See application file for complete search history.

(56) References Cited

U.S. PATENT DOCUMENTS

| | | | | | |
|---|---|---|---|---|---|
| 2,392,746 | A | * | 1/1946 | Labombarde | 271/185 |
| 3,148,879 | A | * | 9/1964 | Kistner | 271/176 |
| 3,236,162 | A | * | 2/1966 | Reist | 198/419.3 |
| 4,156,482 | A | * | 5/1979 | Tomlinson et al. | 198/411 |
| 4,240,539 | A | * | 12/1980 | Klapp | 198/462.2 |
| 4,474,366 | A | * | 10/1984 | Reider | 271/181 |
| 4,732,262 | A | * | 3/1988 | Labombarde | 271/216 |
| 5,186,452 | A | * | 2/1993 | Holbrook | 271/216 |
| 5,244,344 | A | * | 9/1993 | Doeberl et al. | 414/798.2 |
| 5,249,788 | A | * | 10/1993 | Helmstadter | 271/10.07 |
| 5,464,317 | A | * | 11/1995 | Foster et al. | 414/798.2 |
| 5,609,335 | A | * | 3/1997 | Parker | 271/302 |
| 5,615,995 | A | * | 4/1997 | Nobile et al. | 414/798.2 |
| 5,961,114 | A | * | 10/1999 | Barker et al. | 271/184 |
| 6,250,629 | B1 | * | 6/2001 | Brown et al. | 271/220 |
| 6,817,608 | B2 | * | 11/2004 | Sloan et al. | 271/216 |
| 2003/0015835 | A1 | * | 1/2003 | Post et al. | 271/149 |
| 2008/0138188 | A1 | | 6/2008 | Pillard | |

FOREIGN PATENT DOCUMENTS

| | | | |
|---|---|---|---|
| EP | 1 923 343 | A1 | 5/2008 |
| GB | 509 128 | C | 10/1930 |
| JP | 62-60756 | A | 3/1987 |

OTHER PUBLICATIONS

International Search Report of FR 0952325 dated Nov. 24, 2009.

* cited by examiner

*Primary Examiner* — Kaitlin Joerger
(74) *Attorney, Agent, or Firm* — Sughrue Mion, PLLC

(57) ABSTRACT

A storage device for a mail-handling machine, said storage device comprising a mailpiece-receiving deck along a longitudinal edge of which a referencing wall extends, and through which a conveyor belt passes for the purpose of conveying mailpieces along said referencing wall from an inlet of the device towards a sloping surface against which said mailpieces accumulate, said storage device further comprising a pivot arm that is mounted to move both vertically about hinge pin and horizontally along a slide rail, on which arm firstly a friction roller is mounted for pressing said mailpieces against the conveyor belt, and secondly a holding roller is mounted for pressing said mailpieces against the sloping surface.

10 Claims, 1 Drawing Sheet

FIG.1
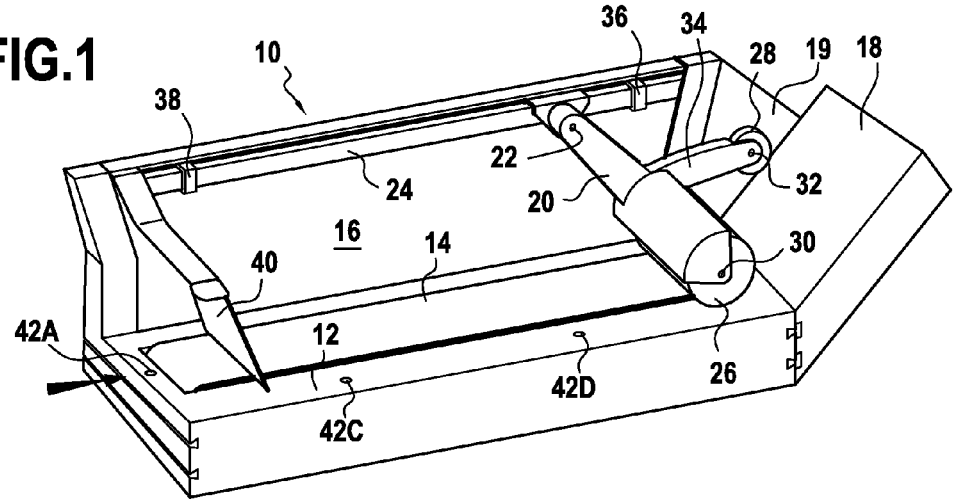
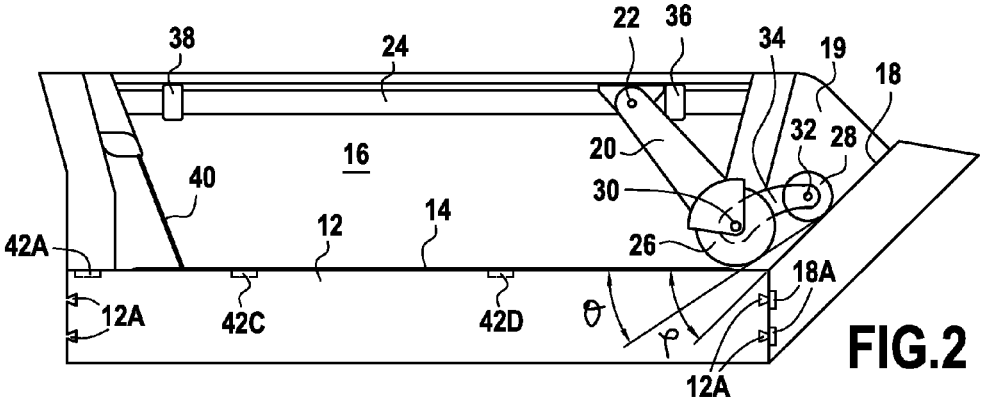
FIG.2
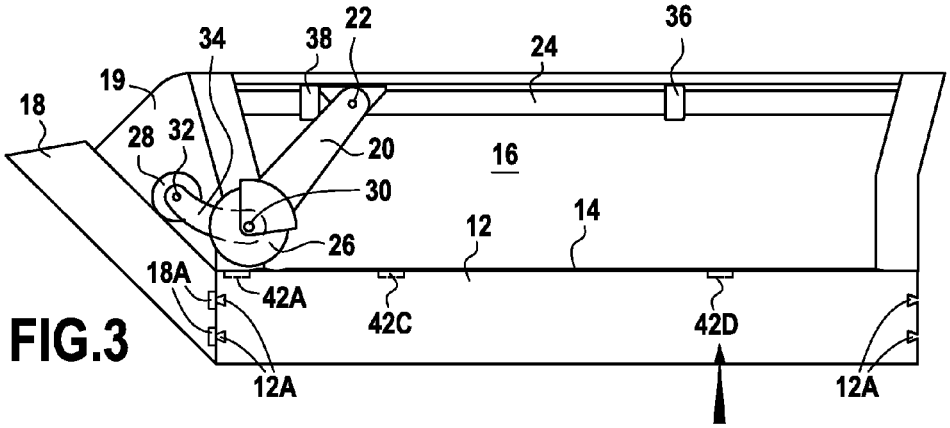
FIG.3

HIGH-CAPACITY DEVICE FOR RECEIVING MAILPIECES

FIELD OF THE INVENTION

The present invention relates to the field of mail-handling and it relates more particularly to a storage device for a mail-handling machine.

PRIOR ART

Current mail-handling machines are increasingly fast, and such high franking rates require their feed and storage capacities to be increased in order to avoid the operator constantly needing to load and unload the machine. However, this increase in the feed and storage capacity must not be achieved to the detriment of the amount of space that needs to be dedicated to the franking machine or "postage meter".

Although this problem can be solved simply for feed devices in which the mailpieces are disposed in a vertical stack and in which an increase in the height of the stack does not give rise to any change in the footprint of the module, i.e. the floor area it occupies, it is much more difficult to solve for storage devices (or stackers) in which such mailpieces are, in conventional manner, stored horizontally, and in which an increase in the quantity of mailpieces stored in this way requires an increase in the area used for such storage.

Thus in many storage devices, the conveyor belt onto which the mailpieces ejected from the mail-handling machine come to rest one-by-one, directs those mailpieces towards a sloping surface in order to stand them up, thereby increasing the storage capacity of the device. Unfortunately, that storage-by-accumulation solution is not fully satisfactory because, although it operates properly for the first mailpieces, it does not operate properly after a certain number of mailpieces because, while the conveyor belt continues to push the bottom portion of the stack against the sloping surface, the top portion is no longer affected by that thrust. As a result, the stack becomes trapezoidal with a small width at its base and a large width at its top that eventually causes the stack to fall onto the conveyor belt, thereby causing the device to jam.

Patent Document U.S. Pat. No. 5,186,452 also discloses a storage device that terminates in a sloping surface and that also has motor-driven rollers above thin conveyor belts that are present over the entire width of the device. Those rollers rotate more slowly than the speed at which the belts advance and, by increasing the coefficient of friction, make it possible for better accumulation in the vertical position to be achieved. In addition, the sloping surface is moved as the mailpieces are being stored, thereby avoiding the trapezoidal stack formation of the prior art. Unfortunately, in addition to its particular complexity due to the motor-drive of the rollers, that device also suffers from the drawback of requiring a very large footprint.

OBJECT AND SUMMARY OF THE INVENTION

The present invention proposes to mitigate the above-mentioned drawbacks by providing a storage device for a mail-handling machine, said storage device comprising a mailpiece-receiving deck along a longitudinal edge of which a referencing wall extends, and through which a conveyor belt passes for the purpose of conveying mailpieces along said referencing wall from an inlet of the device towards a sloping surface against which said mailpieces accumulate, wherein said storage device further comprises a pivot arm that is mounted to move both vertically about hinge pin and horizontally along a slide rail, on which arm firstly a friction roller is mounted for pressing said mailpieces against said conveyor belt, and secondly a holding roller is mounted for pressing said mailpieces against said sloping surface.

Thus, by holding the stack vertical throughout the storage process, it is possible to accumulate a larger number of mailpieces with a device of the same length.

Preferably, said holding roller is mounted at the free end of a secondary arm extending forwards from said pivot arm. Said secondary arm may be hinged about a rotation pin that is secured to said pivot lever so as to enable it to operate regardless of the direction in which the mailpieces arrive.

Advantageously, the angle $\theta$ formed between a tangent to the two rollers and said mailpiece-receiving deck is less than the angle $\phi$ formed between said sloping surface and said mailpiece-receiving deck.

Preferably, said pivot arm is mounted to move between a front first abutment and a rear second abutment. Said front and rear abutments are mounted independently from each other.

Depending on the direction chosen for feeding in the mailpieces, said sloping surface is removable and may be mounted on either of the ends of said mailpiece-receiving deck.

Advantageously, said mailpiece-receiving deck is provided with position sensors, each of which defines a direction of arrival of said mailpieces, depending on the determined position of a selector. Said position sensor detects an overlap of the mailpieces as they arrive on said mailpiece-receiving deck, and causes said conveyor belt to stop when said overlap is not detected.

The device of the invention may also further comprise a flexible flap mounted at the inlet of the device over the entire width of said conveyor belt for the purpose of reducing the speed of ejection of the mailpieces.

BRIEF DESCRIPTION OF THE DRAWING

Other characteristics and advantages of the present invention appear more clearly from the following description given by way of non-limiting indication and with reference to the accompanying drawings, in which:

FIG. 1 is a perspective view of a storage device of the invention;

FIG. 2 is a view of the device of FIG. 1 as seen by the operator, with feed being from the left and accumulation being on the right; and FIG. 3 is a view of a variant of the FIG. 1 device with feed being from the right and accumulation being on the left.

DESCRIPTION OF EMBODIMENTS

FIG. 1 shows a storage device 10 that, in conventional manner, includes a rectangular mailpiece-receiving deck 12 through which a conveyor belt 14 passes that extends over the entire length of the deck along and in the immediate vicinity of a longitudinal referencing wall 16, the end of the deck that is opposite from its end at the inlet of the device being formed by a sloping surface 18. Continuity between the longitudinal wall and the sloping surface is provided by a link plate 19.

In accordance with the invention, this device also includes a pivot arm 20 on which a friction roller 26 and a holding roller 28 are mounted, which pivot arm is mounted to move both vertically about a hinge pin 22 fastened in a manner such that it extends perpendicularly to the referencing wall, and also horizontally along a slide rail 24 fastened to the referencing wall. In order to enable the device to be used in all of the feed and accumulation configurations, the sloping surface 18 and the link plate can be removed and placed at the other end of the device, the pivot arm then itself being turned over. For this purpose, for example, both of the ends of the deck 12 are advantageously provided with grooves 12A designed to co-operate with one or more runners 18A of the sloping surface. Similar or other fastening means are naturally provided on the link plate 19.

The friction roller 26 is mounted idle about a first rotation pin 30 mounted at a free end of said arm and disposed perpendicularly to the direction in which the mailpieces move. By pressing the mailpiece against the conveyor belt, it makes it possible to increase the coefficient of friction between the mailpieces and said belt. The width of the friction roller is at least equal to the width of the conveyor belt whose width is about two-thirds of the width of an envelope of standard European format.

The holding roller 28 is mounted idle about a second rotation pin 32 that is perpendicular to the direction in which the mailpieces move and that is mounted at the free end of a secondary arm 34 that is advantageously hinged about the pin 30 and that extends forwards from the pivot arm 20, i.e. towards the sloping surface. By pressing the mailpieces against the sloping surface 18, it makes it possible, by gravity, to hold the stack vertical so as to prevent it from falling back onto the conveyor belt 14. The hinging makes it possible to turn the roller over about the rotation axis 30 for when the mailpieces accumulate in the other direction.

Thus, under the action of these two rollers, the pivot arm 20 moves vertically depending on the thicknesses of the mailpieces and horizontally as the thickness of the stack lying against the sloping surface 18 increases. This horizontal movement takes place between two abutments, namely a front abutment 36 and a rear abutment 38 (the concepts of front and rear being defined relative to the direction in which the mailpieces advance through the device), which abutments are advantageously movable along the slide rail 24, independently of each other like sliders. Thus, when the device is processing mailpieces that are of large thickness and that are therefore inflexible, the front abutment 36 is moved back to enable the mailpieces to accumulate better. The abutment 38 has the same function when the sloping surface 18 changes ends and is fastened to the opposite end.

In FIG. 2, it can be noted that the angle θ formed between the tangent to the two rollers and the mailpiece-receiving deck is less than the angle ϕ formed between the sloping surface and the mailpiece-receiving deck so that the coefficient of friction between the conveyor belt and the bottom portion of the stack is small. Naturally, the angle θ is maintained by an abutment (not shown).

Since the speed at which the mailpieces are conveyed through the device (which speed is proportional to the speed at which the conveyor belt moves) is less than the speed at which the mailpieces are ejected from the franking machine, a flexible flap 40 is provided above the conveyor belt and over the entire width thereof for the purpose of reducing the speed of the mailpieces arriving in the device. By hitting this speed reducer flap, the mailpieces are stopped and they fall onto the conveyor belt, and they then move with the conveyor belt.

FIG. 3 shows another possible configuration for the device of the invention, in which configuration the mailpieces are ejected towards the referencing wall 16 and then accumulate leftwards against the sloping surface 18 (the flexible flap 40 is removed in this configuration).

In this configuration, and relative to the configuration shown in FIGS. 1 and 2, the sloping surface 18 and the link plate 19 have been moved to the other end of the device and the pivot arm has been turned over about its hinge pin 22. The front abutment 36 has been moved to the centre of the device, facing the outlet slot of the mail-handling machine, so as to make it possible to eject the mailpieces towards the referencing wall 16 without any risk of them hitting the pivot arm 20 which, in this configuration, can therefore move back under the accumulation of the mailpieces over only substantially one half of the length of the device.

The presence of the optical sensors 42A to 42D should be noted. Depending on the feed (or arrival) direction in which the mailpieces are fed in (or arrive) that is chosen by the operator, these optical sensors serve to detect overlapping of the mailpieces and to stop the conveyor belt moving when no actual mailpiece overlap is detected at the inlet of the device. Selecting which one of these sensors is activated is performed by a selector (not shown) disposed at the back of the device.

The device operates as follows. At rest, the holding roller 28 is in contact with the sloping surface 18, and the friction roller 26 is in contact with the conveyor belt 14. When a first mailpiece is ejected from the mail-handling machine onto the mailpiece-receiving deck 12, it is conveyed flat by the conveyor belt towards the sloping surface where it is placed between said sloping surface and the holding roller. The process then continues with the second mailpiece that is then placed between the first mailpiece and the holding roller, thereby causing said holding roller to move back by the thickness of said second mailpiece, and so on with the other mailpieces until the pivot arm comes into abutment with the rear abutment 38. Because of the presence of the holding roller, the mailpieces that have accumulated against the sloping surface remain constantly in a substantially vertical position, and the stack does not collapse. The closeness of the friction roller to the stack, and the difference in angle formed with the tangential plane of the rollers and with the sloping plane also makes it possible for the mailpieces to flex, in particular when they are of small thickness.

It should be noted that, in the above description of operation, no reference is made to the speed-reducing flexible flap. In addition to the flap not being present in the configuration shown in FIG. 3, said flap does not act specifically in the accumulation process, but rather merely to reduce the speed of ejection of the mailpieces when the speed of movement of the conveyor belt is less than the speed of ejection at which the mailpieces are ejected from the mail-handling machine.

Thus, with the present invention a storage device is obtained that is simple, usable in different configurations, and that makes it possible to achieve a significant increase in its storage capacity compared with a device of the same length.

What is claimed is:

1. A storage device for a mail-handling machine, said storage device comprising a mailpiece-receiving deck along a longitudinal edge of which a referencing wall extends, and through which a conveyor belt passes for the purpose of conveying mailpieces along said referencing wall from an inlet of the device towards a sloping surface against which said mailpieces accumulate, wherein said storage device further comprises a pivot arm that is mounted to move both vertically about hinge pin and horizontally along a slide rail, on which arm firstly a friction roller is mounted for pressing said mailpieces against said conveyor belt, and secondly a holding roller is mounted for pressing said mailpieces against said sloping surface.

2. A storage device according to claim 1, wherein said holding roller is mounted at the free end of a secondary arm extending forwards from said pivot arm.

3. A storage device according to claim 2, wherein said secondary arm is hinged about a rotation pin that is secured to said pivot arm so as to enable it to operate regardless of the direction in which the mailpieces arrive.

4. A storage device according to claim 1, wherein the angle θ formed between a tangent to the two rollers and said mailpiece-receiving deck is less than the angle ϕ formed between said sloping surface and said mailpiece-receiving deck.

5. A storage device according to claim 1, wherein said pivot arm is mounted to move between a front first abutment and a rear second abutment.

6. A storage device according to claim 5, wherein said front and rear abutments are mounted independently from each other.

7. A storage device according to claim 1, wherein said sloping surface is removable and can be mounted on either of the ends of said mailpiece-receiving deck.

8. A storage device according to claim 1, wherein said mailpiece-receiving deck is provided with position sensors, each of which defines a direction of arrival of said mailpieces, depending on the determined position of a selector.

9. A storage device according to claim 8, wherein said position sensor detects an overlap of the mailpieces as they arrive on said mailpiece-receiving deck, and causes said conveyor belt to stop when said overlap is not detected.

10. A storage device according to claim 1, further comprising a flexible flap mounted at the inlet of the device over the entire width of said conveyor belt for the purpose of reducing the speed of ejection of the mailpieces.

* * * * *